US008016013B2

(12) United States Patent
Horvath

(10) Patent No.: US 8,016,013 B2
(45) Date of Patent: Sep. 13, 2011

(54) PULL BAR SCREEN APPARATUS AND SYSTEM

(76) Inventor: Louis Horvath, Northpost, AL (US)

( * ) Notice: Subject to any disclaimer, the term of this patent is extended or adjusted under 35 U.S.C. 154(b) by 1031 days.

(21) Appl. No.: 11/300,734

(22) Filed: Dec. 15, 2005

(65) Prior Publication Data

US 2007/0193697 A1 Aug. 23, 2007

(51) Int. Cl.
*E06B 9/08* (2006.01)

(52) U.S. Cl. ..... 160/23.1; 160/393

(58) Field of Classification Search ..... 160/23.1, 160/31, 32, 290.1, 383, 396, 402, 395, 391, 160/392, 393

See application file for complete search history.

(56) References Cited

U.S. PATENT DOCUMENTS

| | | | | | |
|---|---|---|---|---|---|
| 1,909,109 | A | * | 5/1933 | Kopfstein | 160/384 |
| 1,958,018 | A | | 5/1934 | Prawalsky | |
| 1,958,695 | A | | 5/1934 | Claus | |
| 2,255,581 | A | | 9/1941 | Ewing | |
| 2,325,500 | A | | 7/1943 | Fosberg | |
| 2,335,361 | A | | 11/1943 | Schiller | |
| 2,350,235 | A | * | 5/1944 | Johnson | 160/387 |
| 3,005,489 | A | | 10/1961 | Crocker et al. | |
| 3,524,491 | A | * | 8/1970 | Olson | 160/393 |
| 4,258,517 | A | * | 3/1981 | Hammond | 52/202 |
| 4,393,585 | A | * | 7/1983 | Nagelkerke | 30/34.1 |
| 4,393,915 | A | * | 7/1983 | Olson | 160/395 |
| 4,398,585 | A | * | 8/1983 | Marlow | 160/23.1 |
| 4,458,739 | A | * | 7/1984 | Murray et al. | 160/23.1 |
| 4,480,676 | A | * | 11/1984 | Solomon | 160/272 |
| 4,610,292 | A | * | 9/1986 | Hausmann et al. | 160/120 |
| 5,090,468 | A | * | 2/1992 | Tedeschi | 160/290.1 |
| 5,092,388 | A | | 3/1992 | Evers | |
| 5,301,737 | A | | 4/1994 | Martin | |
| 5,934,353 | A | | 8/1999 | Buhr | |
| 6,082,432 | A | | 7/2000 | Kissinger | |
| 6,876,493 | B1 | * | 4/2005 | Lin | 359/461 |

* cited by examiner

*Primary Examiner* — David Purol
(74) *Attorney, Agent, or Firm* — Woodcock Washburn LLP

(57) ABSTRACT

A pull bar screen apparatus and system in which screen is mechanically attached directly to a pull bar. Weld-less friction-lock cold-joining of screen and pull bar provides an improved pull-bar screen apparatus used in retractable pull screens. The pull bar screen apparatus and system remove the need for attaching a vinyl strip to the screen. Instead, the screen is flattened to retain its form and structural integrity. On one elongated end of the screen, an upper and lower lock bar are placed on either side of the screen. Corrugated ridges in the lock bars pinch the screen and hold it in place. A lock bar casing is placed under pressure around the upper and lower lock bars which hold the lock bars in position and thereby retain the screen.

17 Claims, 4 Drawing Sheets

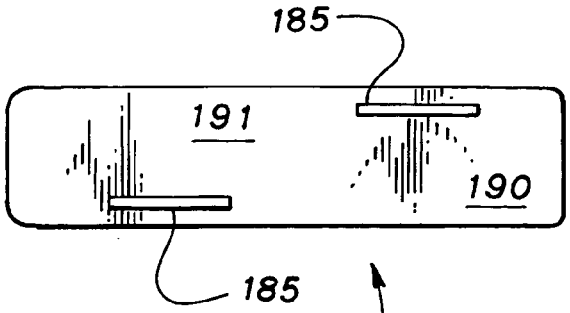
Fig_7
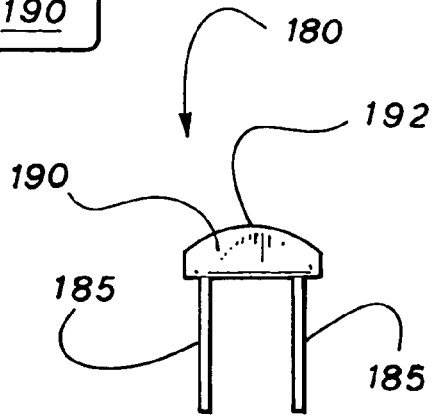
Fig_8
Fig_9
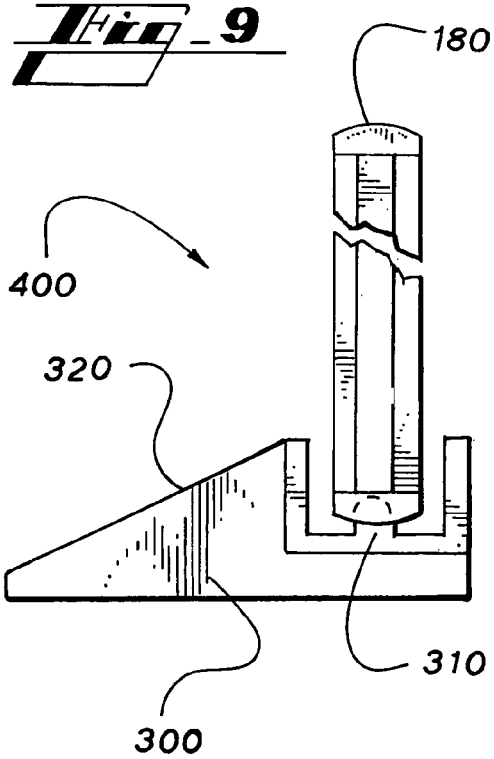
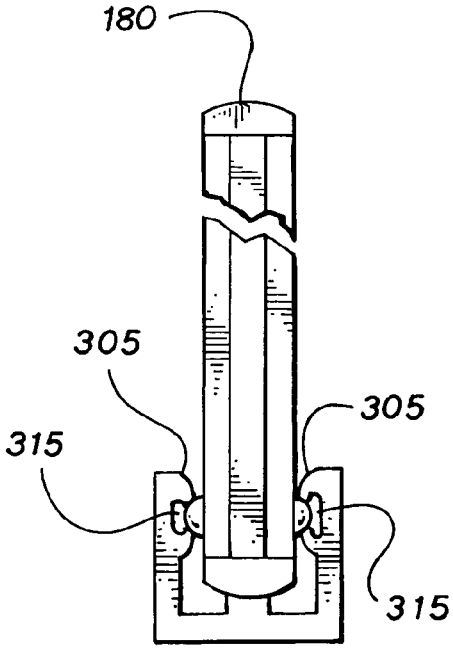
Fig_10

PULL BAR SCREEN APPARATUS AND SYSTEM

BACKGROUND

I. Field of the Invention

The present invention relates generally to the field pull bar screens and more particularly to a pull bar screen apparatus and system.

II. Description of the Related Art

Fixed frame screens have been used for seasonal placement typically to prevent insects from entering into houses while having windows open. Fixed frame screens are either left in place permanently or are taken out in the off-season for storage in attics, basements and the like. The fixed frame screens typically represent perpetual maintenance problems because they are frail. In contrast, retractable screen systems are housed in a cassette that is permanently mounted to a portion of either a door or window frame and never need to be removed for storage. When not in use, they simply retract into the permanently mounted cassette. Retractable screens have also increased in popularity for use as sun screens.

In manufacturing retractable screens, there are several flaws that reduce the overall quality and structural integrity of the retractable screen product. Typically, high frequency welding is used to connect a screen sheet between two flaps of a vinyl strip, which is pre-positioned within a channel of an extruded pull-bar. The high frequency welding applies electronically controlled quantities of heat and pressure to weld one side of the screen to the vinyl strip. The sheet of screen is welded after the positioning of the vinyl strip. FIG. 1 illustrates a top exploded view the constituent components of a prior art pull bar apparatus 50. As described above, the apparatus 50 generally includes a cassette holder 55 in which the retractable screen material 60 is held. A vinyl strip 70 is welded to a lower end of the screen 60. A high frequency weld 65 is used to connect the screen 65 and the vinyl strip. In general, a pull bar 75 is then connected to the vinyl strip and a portion of the screen 60 to cover the weld 65.

In general, it is appreciated that imperfect positioning of the unsupported sheet of screen often occurs. In addition, there are uneven expansion factors between the screen and the strip thereby causing unsightly wave patterns in the screen. Therefore, the vinyl strip is typically the flaw of present retractable pull screens. However, in order to retain aesthetic appearance, this process continues to be used.

SUMMARY

In general, the invention features a pull bar screen apparatus and system in which screen is mechanically attached directly to a pull bar. The invention features weld-less friction-lock cold-joining of screen and pull bar that provides an improved pull-bar screen apparatus used in retractable pull screens. The present invention removes the need for attaching a vinyl strip to the screen. Instead, the screen is flattened to retain its form and strength. On one elongated end of the screen, an upper and lower lock bar are placed on either side of the screen. Corrugated ridges in the lock bars pinch the screen and hold it in place. A lock bar casing is placed under pressure around the upper and lower lock bars which hold the lock bars in position and thereby retain the screen.

In general, the invention features a pull-screen apparatus, including a sheet of screen, a first lock bar, a second lock bar placed in opposition to the first lock bar, wherein an end of the sheet of screen is interposed between the first and second lock bars and a lock bar casing surrounding the first and second lock bars.

In one implementation, the apparatus further includes a cassette housing into which the screen is retractable.

In another implementation, the lock bar casing has a generally U-shape profile, having a first end and a second end.

In another implementation, the apparatus further includes an end cap affixed to each of the first and second ends.

In another implementation, the end caps each include a cap head and a blade extension connected to a lower surface of the cap head.

In another implementation, the blade extension mates with a cavity formed between an inner wall of the lock-bar casing and an outer surface of one of the first and second lock bars.

In still another implementation, the lock bars each comprise an inner an outer surface, the inner and outer surfaces being inverted mirror images of each other.

In yet another implementation, the inner surfaces each comprise a series of elongated rods forming a corrugated surface for mating with a respective corrugated surface.

In another implementation, the outer surfaces each comprise an elongate channel offset and parallel to a respective elongate channel on a respective outer surface.

In another implementation, the interposition of the screen between the first and second lock bars create a friction lock.

In another aspect, the invention features a pull-bar screen system, including a screen for retraction into and extension from a cassette housing, a lock-bar casing connected to a lower end of the screen, the pull-bar providing a means for retracting and extending the screen into and out of the cassette housing, lock bars positioned on either side of the lower end of the screen and within the lock bar casing, wherein the lock-bar casing and the lock bars form a pull-bar and end caps connected to either end of the lock bar casing.

In one implementation, the system further includes a bottom rail for interconnection with the pull-bar when the pull-bar is pulled into a retracted position, thereby holding the retracted screen in an open position.

In another implementation, the system further includes a female indentation located on an outer end of the pull bar for mating with a male protrusion on the bottom rail.

In another implementation, the system further includes means for receiving the pull-bar into the bottom rail.

In another implementation, the system further includes a frame having an upper end and a lower end, the cassette housing being connected adjacent the upper and the bottom rail being connected adjacent the lower end.

In another aspect, the invention features a pull-bar screen system, including a sheet of screen material, a pull bar located on one end of the screen material, the pull-bar having a first end and a second end, means for creating a mechanical friction lock on an end of the screen material and located within the pull-bar and an end cap positioned on both ends of the pull bar.

In one implementation, the end caps include blade extensions for interconnection with the means for creating a friction lock.

In another implementation, the system further includes a lock bar casing surrounding the means for creating a friction lock.

In another implementation, the lock bar casing includes an opening through which the sheet of screen material protrudes and is pinched by the means for creating a friction lock, the pinching occurring adjacent the opening.

In another implementation, the means for creating a friction lock is a mated set of corrugated surfaces placed in opposition to one another and holding the screen therein.

One advantage of the invention is that screen material is connected directly to a pull bar.

Another advantage of the invention is that the pull bar of the pull bar screen is connected directly to the screen through frictional lock bars.

Another advantage of the invention is that the need for high frequency welding is eliminated.

Another advantage of the invention is that it eliminates the need for vinyl strip extrusion.

Another advantage of the invention is that the pultruded pull-bar can take place of presently available pull-bars without necessitating modification of the existing pull-bar system, thereby allowing retrofitting of existing systems.

Another advantage of the invention is that it can be implemented as a new system.

Another advantage of the invention is that the screen material is not deformed when it is connected to the pull bar, thereby being held in place by frictional contact.

Another advantage of the invention is that the structural integrity of the screen is increased.

Other objects, advantages and capabilities of the invention are apparent from the following description taken in conjunction with the accompanying drawings showing the preferred embodiment of the invention.

BRIEF DESCRIPTION OF THE DRAWINGS

FIG. 7 illustrates a bottom view of an embodiment of a pull bar end cap;

FIG. 8 illustrates an end view of an embodiment of a pull bar end cap;

FIG. 9 illustrates an embodiment of a bottom rail for a pull bar apparatus; and FIG. 10 illustrates an alternate embodiment of a bottom rail for a pull bar apparatus.

DETAILED DESCRIPTION

Figure 1:
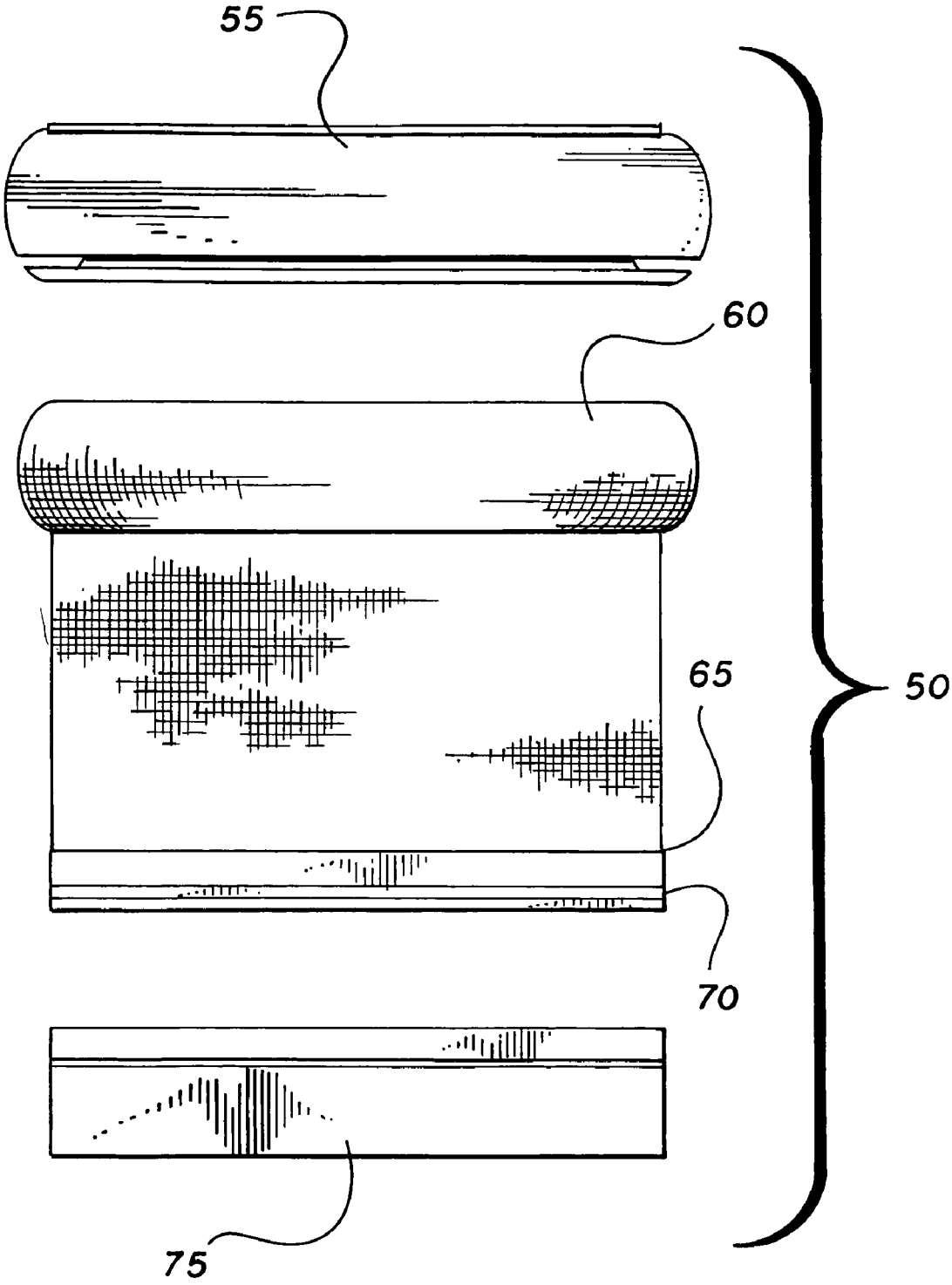
Fig. 1 PRIOR ART
FIG. 1 illustrates a top exploded view the constituent components of a prior art pull bar apparatus.
Figure 2:
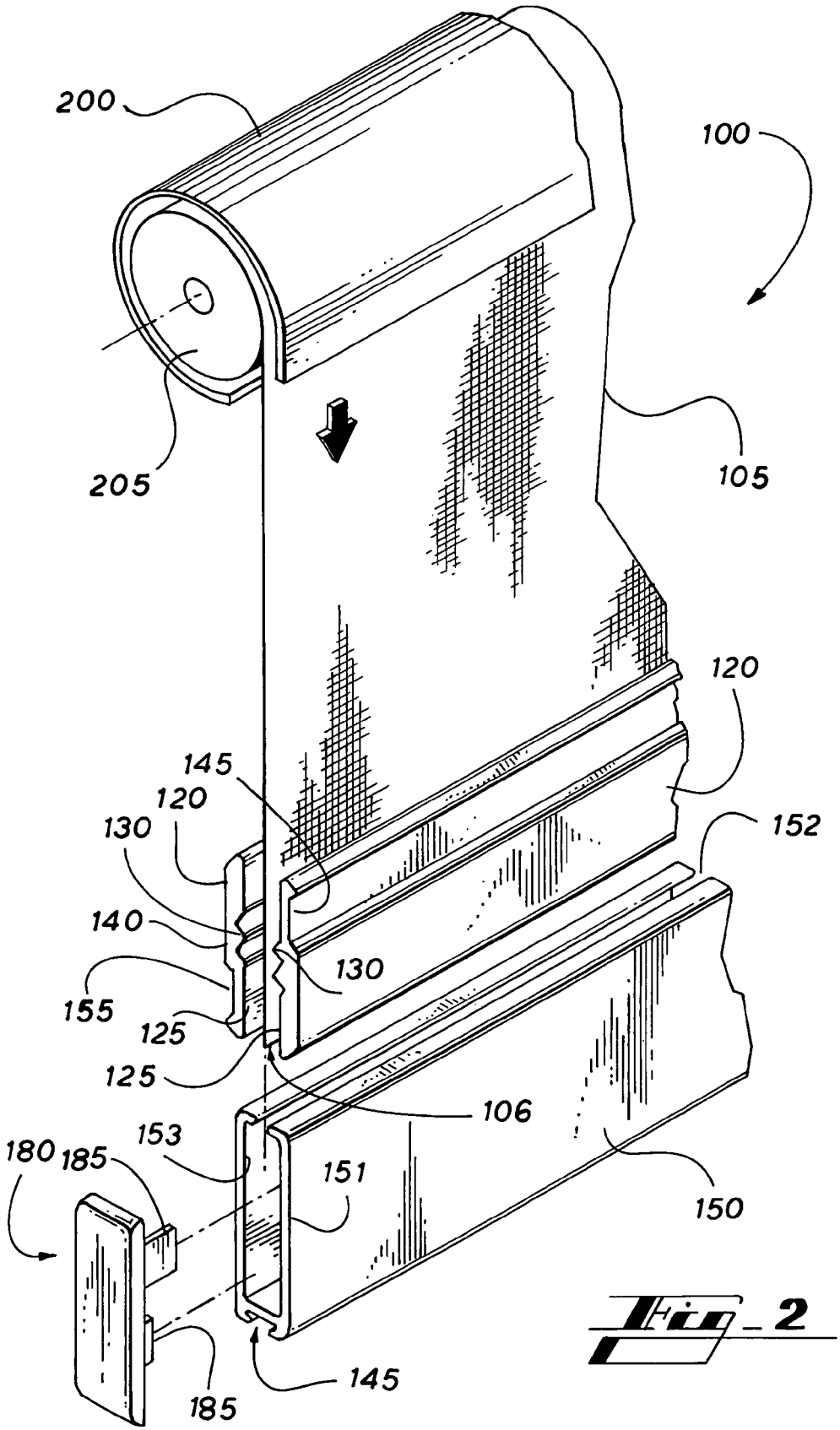
FIG. 2 illustrates a perspective exploded view of the constituent components of an embodiment of a pull bar screen apparatus.

Referring to the drawings wherein like reference numerals designate corresponding parts throughout the several figures, reference is made first to FIG. 2 that illustrates a perspective exploded view of the constituent components of an embodiment of a pull bar screen apparatus 100. In general, the apparatus 100 includes a sheet of screen 105 material that can be formed from a variety of materials, but typically is formed of a suitable mesh material such as vinyl. The apparatus 100 further includes two opposing lock bars 120 that are typically inverted mirror images of one another. The lock bars 120 typically include an inner corrugated surface 125, the corrugated inner surface being generally formed from elongated parallel ridges 130. The corresponding elongated ridges 130 of the inverted mirror image lock bar 120 are placed together in mated engagement when the opposing lock bars 120 are placed together with the inner corrugated surfaces 125 in mechanical contact. A lower edge 106 of the screen 105 is placed in between the inner corrugated surfaces 125 such that the lower edge 106 is held between the ridges 130 of the inner corrugated surfaces 125 and retained by frictional contact. The lock bars 120 further include an outer surface 140 that each include an elongated channel 145.

The apparatus 100 further includes an outer lock bar casing 150 that is placed around the lock bars 120 after placement of the lower edge 106 of the screen 105 between the lock bars 120. As discussed further in the description below, the lock bar casing 150 has a generally U-shape profile that is biased toward a closed position such that a force must be asserted against the bias in order to place the engaged lock bars 120 within the lock bar casing 150.

The apparatus 100 further includes end caps 180 that are placed on the open ends of the lock bar casing 150 after placement of the lock bars 120 and the screen 105 is achieved as immediately described above. In general, the end caps 180 each include blade extensions 185 that are discussed further in the description below.

In general, it is appreciated that the apparatus 100 described above can advantageously include a cassette housing 200 into which the screen 105 can retract. Those skilled in the art appreciate that the cassette housing can include a spring loaded roll bar 205 onto which the screen 105 can retract as needed. It is understood that there are a variety of additional devices that can retract the screen into cassette housing 200.

Figure 3:
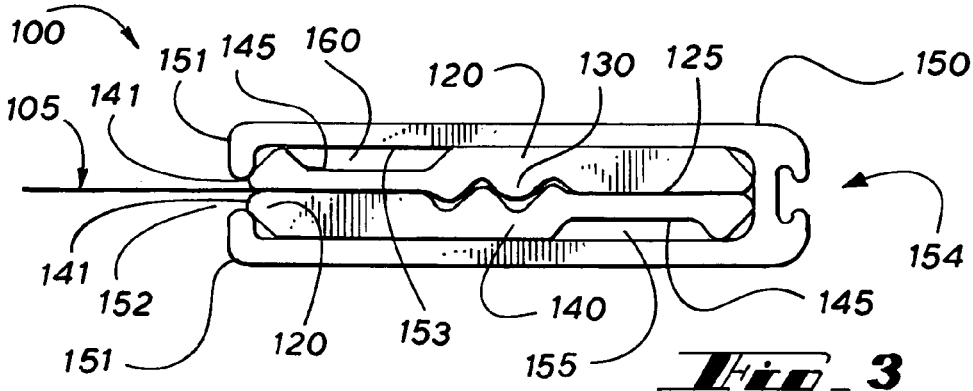
FIG. 3 illustrates an end view of an embodiment of an assembled pull bar.

FIG. 3 illustrates an end view of an embodiment of an assembled pull bar formed by the lock bars 120 and the lock bar casing 150. As described above, the apparatus 100 includes a sheet of screen 105 material having a lower edge 106 that is interposed and held in frictional contact between and with the two opposing lock bars 120. The inner corrugated surfaces 125, being generally formed from elongated parallel ridges 130, are in mated engagement with one another. The lock bars 120 further include an outer surface 140 that each include an elongated channel 145. The apparatus 100 further includes an outer lock bar casing 150 that is placed around the lock bars 120 after placement of the lower edge 106 of the screen 105 between the lock bars 120. As mentioned above, the lock bar casing 150 has a generally U-shape profile that is biased toward a closed position. The open end of the U-shape includes lips 151 that are positioned in opposition to one another thereby forming an opening 152 through which the screen 105 protrudes from the lock bar casing 150. The lock bars 120 further include rounded ends 141 that when brought together with corresponding rounded ends 141, a set of lips is formed adjacent and pinched within the opening 152 thereby providing an additional pinching and thus increased frictional contact of the lower edge 106 of the screen 105 between the lock bars 120. The lock bar casing 150 generally further includes a closed end 154.

The lock bar casing 150 further generally includes an inner surface 153 that is in mechanical contact with the outer surface 140 of the lock bars 120. However, a cavity 160 is formed in the assembled state due to the presence of the channel 145 on the outer surface 140 of the lock bars 120.

Figure 4:
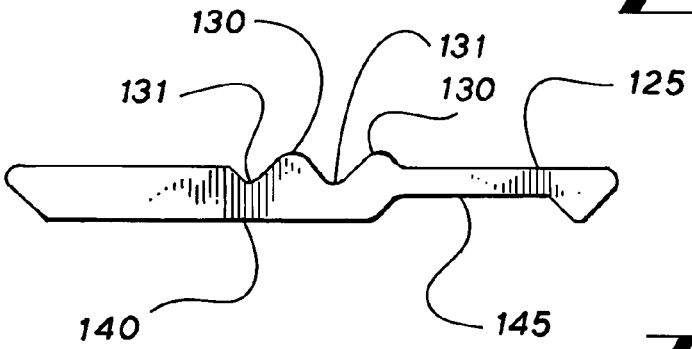
FIG. 4 illustrates an end view of an embodiment of a friction lock bar.

FIG. 4 illustrates a end view of an embodiment of a friction lock bar 120. AS described above, the lock bars 120 are typically inverted mirror images of one another. The lock bars 120 typically include an inner corrugated surface 125, the corrugated inner surface being generally formed from elongated parallel ridges 130, which include corresponding troughs 131 thereby creating the corrugated surface 125. The corresponding elongated ridges 130 of the inverted mirror image lock bar 120 are placed together in mated engagement when the opposing lock bars 120 are placed together with the inner corrugated surfaces 125 in mechanical contact. The lock bars 120 further include an outer surface 140 that each include an elongated channel 145. The lock bars 120 further include rounded ends 141.

Figure 5:
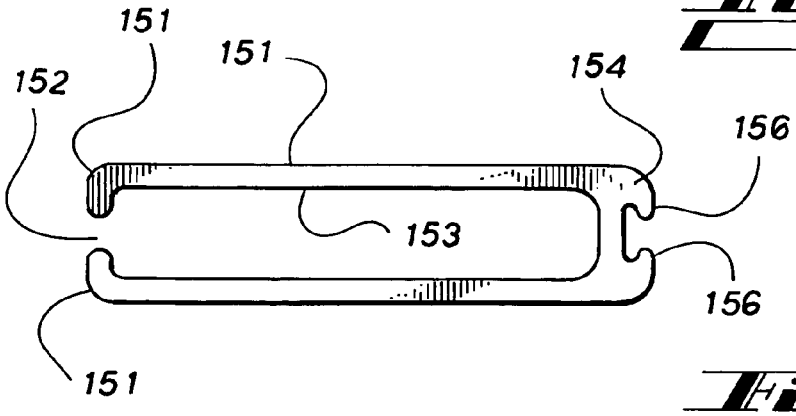
FIG. 5 illustrates a side view of an embodiment of a lock bar casing.

FIG. 5 illustrates a side view of an embodiment of a lock bar casing 150. As described above, the outer lock bar casing 150 is placed around the lock bars 120 after placement of the lower edge 106 of the screen 105 between the lock bars 120. The lock bar casing 150 has a generally U-shape profile that is biased toward a closed position such that a force must be asserted against the bias in order to place the engaged lock bars 120 within the lock bar casing 150. The lock bar casing 150 further generally includes an inner surface 153.

The open end of the U-shape includes lips 151 that are positioned in opposition to one another thereby forming an opening 152 through which the screen 105 protrudes from the lock bar casing 150. The lock bar casing 150 generally further includes a closed end 154. The closed end 154 can further include claws 156 that are described further below.

Figure 6:
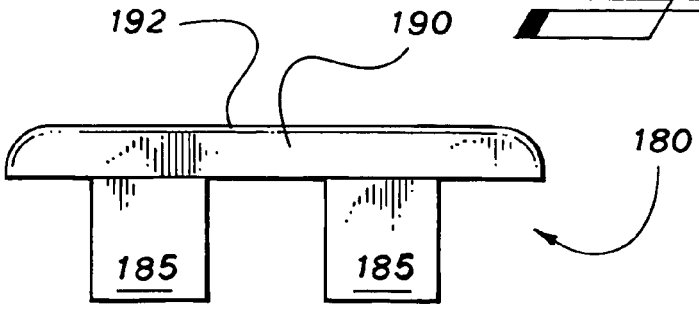
FIG. 6 illustrates a side view of an embodiment of a pull bar end cap.

FIG. 6 illustrates a side view of an embodiment of a pull bar end cap 180. FIG. 7 illustrates a bottom view of an embodiment of a pull bar end cap 180. FIG. 8 illustrates an end view of an embodiment of a pull bar end cap 180. In general, the end cap 180 includes blade extension 185 that are connected to a lower surface 191 of a cap head 190. In general, the lower surface 191 comes into contact with the ends of the pull bar that includes the lock bar casing 150 and lock bars 120 in between. The outer surface 192 can be rounded for an aesthetic appearance. Referring again to FIG. 3, it is appreciated that blade extensions advantageously fit into the cavities 160 created from bringing the channels 145 into proximity to the inner surface 153 of the lock bar casing 150. It is further appreciated that since the lock bars 120 are inverted mirror images of each other, the corresponding channels are positioned parallel but offset from one another. Therefore, the blade extensions 185 are correspondingly positioned on the cap head 190 in a parallel but offset orientation. With the cavities 160 and blade extensions 185 being in corresponding positions, the blade extensions 185 can easily mate with the cavities 160 to create a snug fit of the end caps 180 on the ends of the lock bar casing 150.

In general, the apparatus 100 in conjunction with the cassette housing 200 as well as additional devices can form a pull bar screen system and kit, which can be used as a new installation into existing door and window frames or as a retrofit to existing pull bar screen systems.

FIG. 9 illustrates an embodiment of a bottom rail 300 for a pull bar apparatus 100, thereby forming a pull bar screen system 400. In general, the bottom rail can include a U-shape channel or bottom guide pultrusion 305 into which the pull bar (formed by lock bars 120, lock bar casing 150 and end caps 180) can be fitted and retained. The lock bar casing 150 can be fitted to a corresponding protrusions 310 located within the channel 305 that aids in closing any gaps created by the lack screen on the pull bar. Alternatively, the channel 305 can include side claws 315 that can create a frictional connection with the sides of the lock bar casing as shown in FIG. 10 that illustrates an alternate embodiment of a bottom rail for a pull bar apparatus 100. The bottom rail 300 can further include an outer ramp 320.

The foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A pull-screen apparatus, comprising:

a sheet of screen;

a first lock bar;

a second lock bar placed in opposition to the first lock bar, wherein an end of the sheet of screen is interposed between the first and second lock bars; and a lock bar casing surrounding the first and second lock bars, wherein an outer surface of said first lock bar and an outer surface of said second lock bar each comprises an elongate channel, said channel of said first lock bar being offset from and parallel to said elongate channel on a said second lock bar.

2. The apparatus as claimed in claim 1, wherein the lock bar casing has a generally U-shape profile, a first end, and a second end, wherein said lock bar casing is biased towards a closed position.

3. The apparatus as claimed in claim 2, further comprising an end cap affixed to each of the first and second ends, each said end cap comprising a cap head and a blade extension connected to a lower surface of said cap head, wherein said blade extension mates with a cavity within said lock bar casing.

4. The apparatus as claimed in claim 3, wherein said blade extension mates with a cavity formed between an inner wall of said lock bar casing and an outer surface of one of said first and second lock bars.

5. The apparatus as claimed in claim 1, wherein an inner surface of said first lock bar and an inner surface of said second lock bar each comprises a series of elongated rods forming a corrugated surface for mating with a respective corrugated surface.

6. The pull-screen apparatus of claim 1, wherein said lock bar casing comprises a pair of opposing lips defining an opening therebetween, and wherein said first lock bar and said second lock bar do not protrude through said opening.

7. The pull-screen apparatus of claim 6, wherein said first lock bar and said second lock bar comprise rounded ends proximate said opening, and wherein said opposing lips pinch said first lock bar and said second lock bar proximate said rounded ends.

8. The pull-screen apparatus of claim 1, wherein said first lock bar and said second lock bar comprise rounded ends proximate an opening of said lock bar casing, whereby a force tending to extract said first lock bar and said second lock bar from said lock bar casing through said opening pinches said first lock bar and said second lock bar.

9. The pull-screen apparatus of claim 1, wherein a tension of said sheet of screen increases a force retaining said sheet of screen between said first lock bar and said second lock bar.

10. A pull-bar screen system, comprising:

a screen for retraction into and extension from a cassette housing;

a lock-bar casing connected to a lower end of the screen, the pull-bar providing a means for retracting and extending the screen into and out of the cassette housing;

lock bars positioned on either side of the lower end of the screen and within the lock bar casing, wherein the lock-bar casing and the lock bars form a pull-bar;

end caps connected to either end of the lock bar;

a bottom rail for interconnection with the pull-bar when the pull-bar is pulled into a retracted position, thereby holding the retracted screen in an open position; and a female indentation located on an outer end of the pull bar for mating with a male protrusion on the bottom rail.

11. The system as claimed in claim 10 further comprising means for receiving the pull-bar into the bottom rail.

12. The system as claimed in claim 10 further comprising a frame having an upper end and a lower end, the cassette housing being connected adjacent the upper end and the bottom rail being connected adjacent the lower end.

13. A screen pull bar consisting of:

a casing having two ends and a generally U-shape profile with opposing lips defining an opening therebetween;

a first lock bar;

a second lock bar; and end caps disposed proximate said two ends, wherein said first lock bar and said second lock bar are removably operable with said casing.

14. The screen pull bar of claim 13, wherein said casing is biased against separation of said opposing lips.

15. The screen pull bar of claim 14, wherein said first lock bar and said second lock bar have tapered portions proximate said opening, and wherein said first lock bar is biased towards said second lock bar by said casement.

16. The screen pull bar of claim 14, wherein at least one of said first lock bar and said second lock bar comprises a tapered portion proximate said opening, and wherein extraction of said tapered portion through said opening causes separation of said opposing lips.

17. The screen pull bar of claim 13, wherein each said end cap comprising at least one blade extension, said at least one blade extension operable with at least one of said first lock bar and said second lock bar.

* * * * *